US011701677B2

(12) United States Patent
Chou

(10) Patent No.: US 11,701,677 B2
(45) Date of Patent: Jul. 18, 2023

(54) WATER STREAM STOP VALVE FOR SPRINKLER

(71) Applicant: PLASTICO CORPORATION, Taipei (TW)

(72) Inventor: Tsung Min Chou, Taipei (TW)

(73) Assignee: Plastico Corporation, Taipei (TW)

( * ) Notice: Subject to any disclaimer, the term of this patent is extended or adjusted under 35 U.S.C. 154(b) by 150 days.

(21) Appl. No.: 17/145,685

(22) Filed: Jan. 11, 2021

(65) Prior Publication Data

US 2022/0219183 A1 Jul. 14, 2022

(51) Int. Cl.
*B05B 12/08* (2006.01)
*B05B 15/74* (2018.01)

(52) U.S. Cl.
CPC ..... *B05B 12/087* (2013.01); *B05B 15/74* (2018.02)

(58) Field of Classification Search
CPC ..... B05B 1/3006; B05B 1/323; B05B 12/087; B05B 15/70; B05B 15/72; B05B 15/74
See application file for complete search history.

(56) References Cited

U.S. PATENT DOCUMENTS 5,174,500 A * 12/1992 Yianilos ..... B05B 1/304 239/570
5,524,824 A * 6/1996 Frimmer ..... B05B 15/74 116/277
6,178,982 B1 * 1/2001 Longstreth ..... B05B 1/304 137/71
6,732,946 B2 * 5/2004 Veazie ..... B05B 15/74 239/71
8,833,672 B2 * 9/2014 Skripkar ..... B05B 15/74 137/71
9,192,956 B2 * 11/2015 Kah, Jr. ..... B05B 15/40
10,850,295 B2 * 12/2020 Wildt ..... B05B 15/14
2011/0068195 A1 * 3/2011 Franks ..... B05B 1/3006 239/203

* cited by examiner

*Primary Examiner* — Darren W Gorman
(74) *Attorney, Agent, or Firm* — Rosenberg, Klein & Lee

(57) ABSTRACT

A water stream stop valve for a sprinkler includes a tube body, an annular cover, multiple securing units, and a drainage body having a hole at the center thereof, is arranged above the tube body by multiple support plates. The water stream stop valve is incorporated in a pop-up sprinkler that includes a main body, an expansion pipe with a stop member arranged at top internal diameter thereof, a spray head, and the water stream stop valve arranged inside the expansion pipe and below the spray head. When the spray head falls off expansion pipe, the water stream stop valve will be pushed up to the top of the expansion pipe and stop at the stop member for avoiding the overflow of water while maintaining the spraying at the original area, and delivering a service indication stream.

3 Claims, 8 Drawing Sheets

WATER STREAM STOP VALVE FOR SPRINKLER

BACKGROUND OF THE INVENTION

1. Field of the Invention

The invention relates to a water stream stop valve for sprinkler, especially to one that can avoid the overflow of water, maintain the spraying at the original area, and deliver a service indication stream, when the spray head fell off.

2. Description of the Related Art

Referring to FIGS. 1-3, the main body 11 of the prior art pop-up sprinkler 10 is buried underground, the main body 11 having an expansion pipe 12 arranged inside and enable to pop out the ground and watering the ground by the spray head 13, so this type pop-up sprinkler 10 can make the installation site tidier; however, once the spray head 13 of the pop-up sprinkler 10 fell off (there is a filter 14 at the bottom of the spray head 13, the filter 14 will fall off together with the spray head 13), the water stream will leak from the top of the expansion pipe 12, as FIG. 4 showing, and if doesn't notice the fell off of the spray head 13 will cause the flooding and the low water pressure of other pop-up sprinkler 10.

SUMMARY OF THE INVENTION

It is a primary objective of the present invention to provide a water stream stop valve for sprinkler that cam solve the water leakage problem while the sprinkler fell off.

It is another objective of the present invention to provide a water stream stop valve for sprinkler that maintain the spraying at the original area, and deliver a service indication stream In order to achieve the above objectives, the present invention includes: a tube body; an annular cover arranged on the outer periphery of the tube body; multiple securing units arranged vertically on the outer periphery of the tube body; a drainage body having a hole at the center is arranged above the tube body by multiple support plates, and the aperture of the hole is smaller than the top internal diameter of the tube body;

Moreover, the internal diameter of the tube body gradually shrinks from bottom to top, and the bottom surface of the drainage body is upwards from the inside to the outside.

Whereby water stream stop valve is applied in a pop-up sprinkler, wherein the pop-up sprinkler includes: a main body; an expansion pipe arranged on the main body, and having a stop member arranged at top internal diameter thereof; a spray head arranged at the top edge of the expansion pipe; and the water stream stop valve is arranged inside the expansion pipe and below the spray head; When the spray head fell off, due to the water pressure, the water stream stop valve will be pushed up to the top of the expansion pipe and stop at the stop member for avoiding the overflow of water, maintaining the spraying at the original area, and delivering a service indication stream.

DETAILED DESCRIPTION OF THE PREFERRED EMBODIMENT

Figure 1:
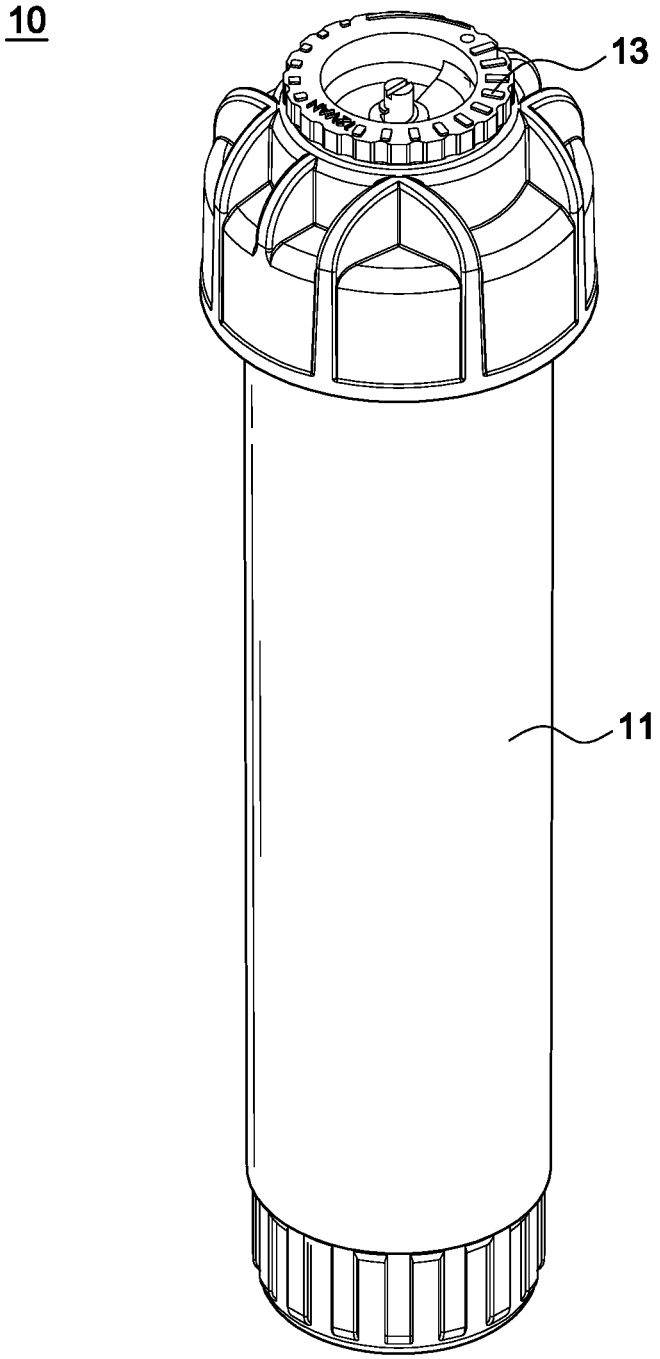
FIG.1 PRIOR ART
FIG. 1 is a schematic diagram illustrating a pop-up sprinkler according to the prior art, while the expansion pipe is hidden.
Figure 2:
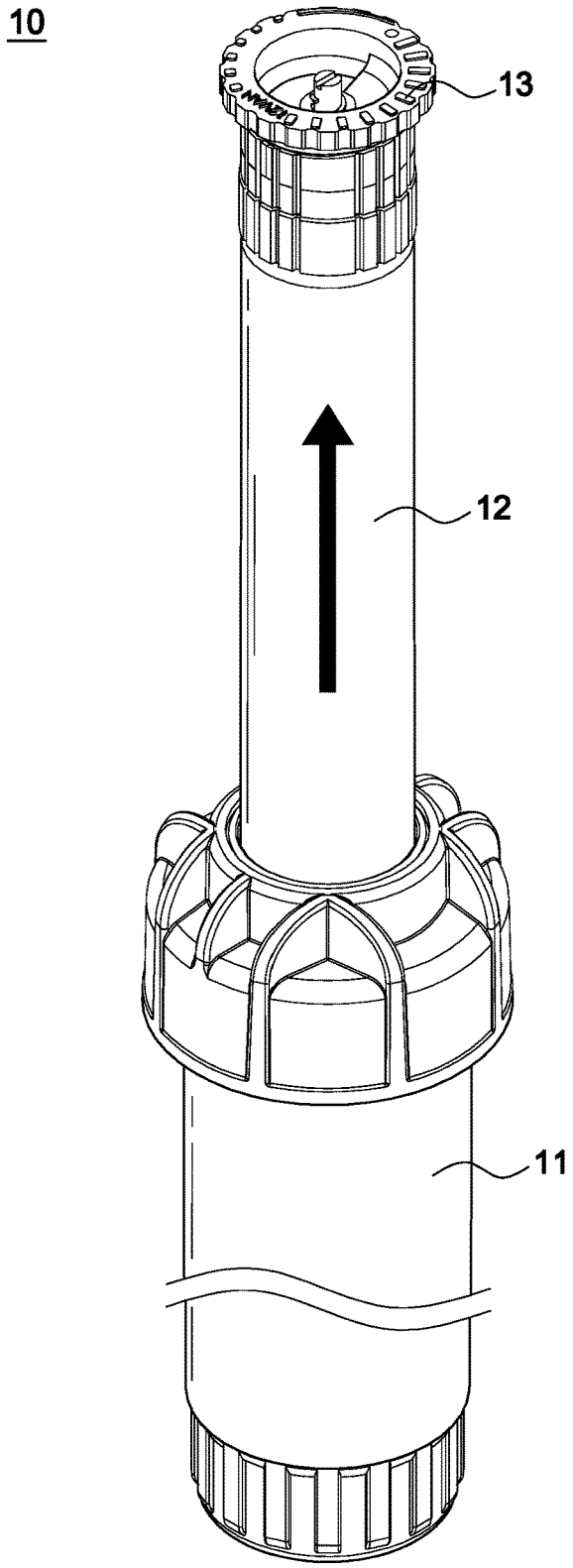
FIG.2 PRIOR ART
FIG. 2 is a schematic diagram illustrating the pop-up sprinkler according to the prior art, while the expansion pipe is pop-up.
Figure 3:
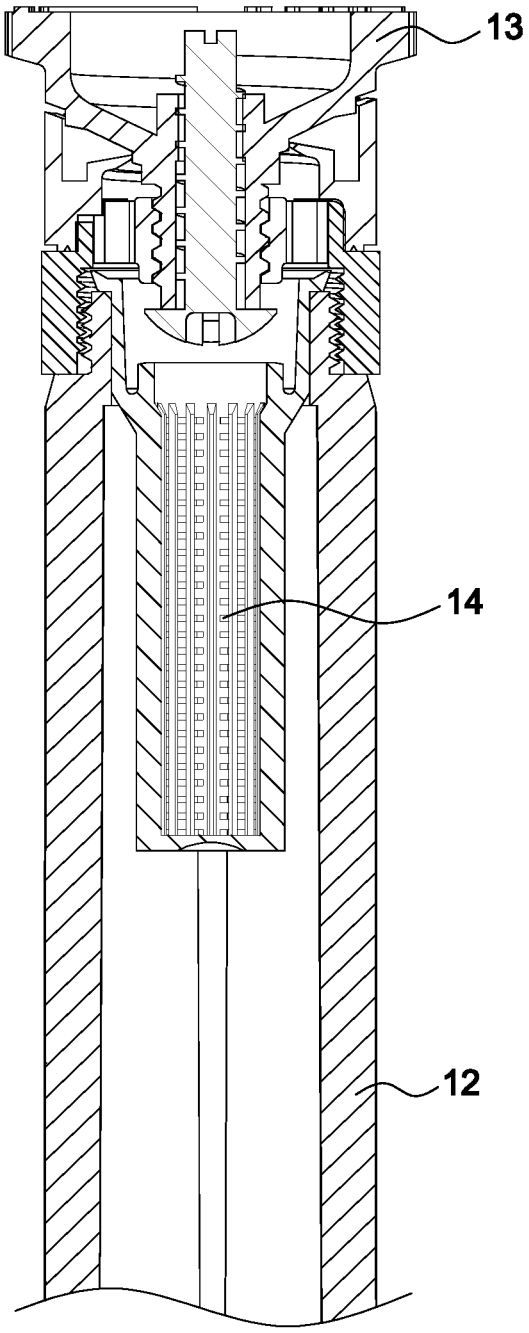
FIG.3 PRIOR ART
FIG. 3 is a schematic diagram illustrating the structure of a pop-up sprinkler according to the prior art.
Figure 4:
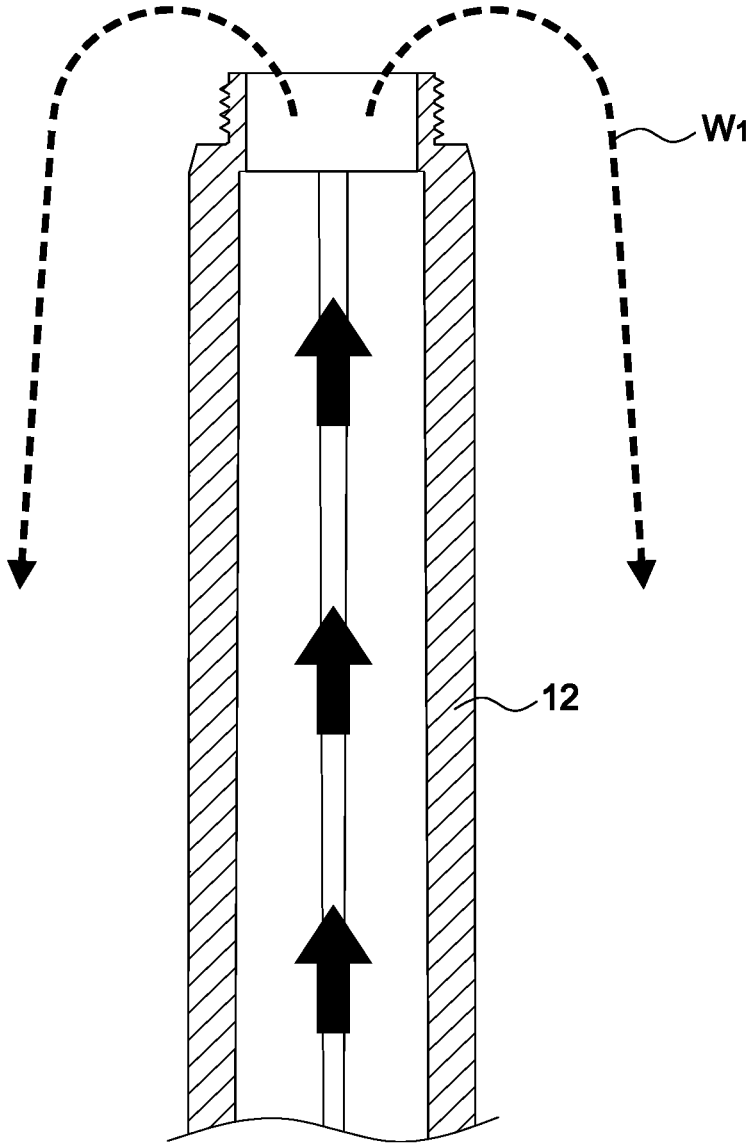
FIG.4 PRIOR ART
FIG. 4 is a schematic diagram illustrating the structure of a pop-up sprinkler according to the prior art, while the spray head fell off.
Figure 5A:
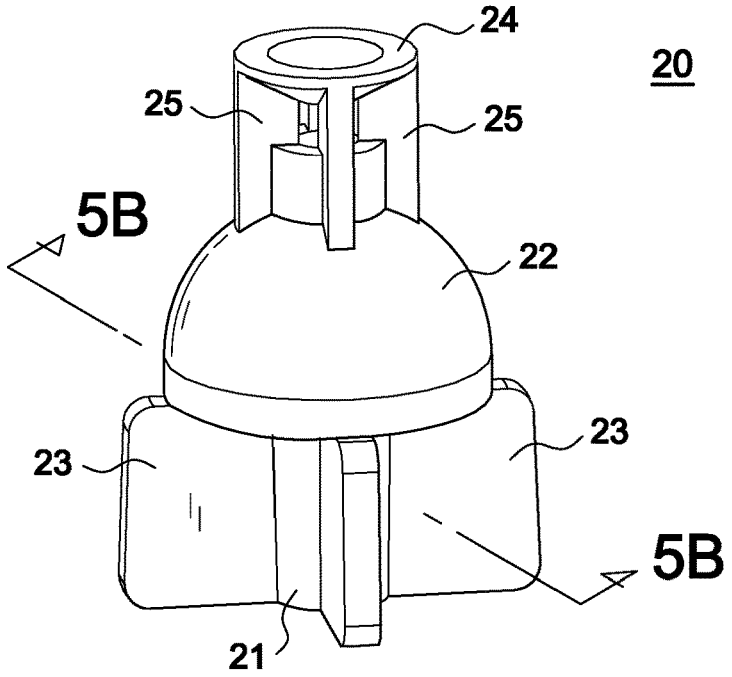
FIG. 5A is a perspective views of the water stream stop valve of the present invention.
Figure 5B:
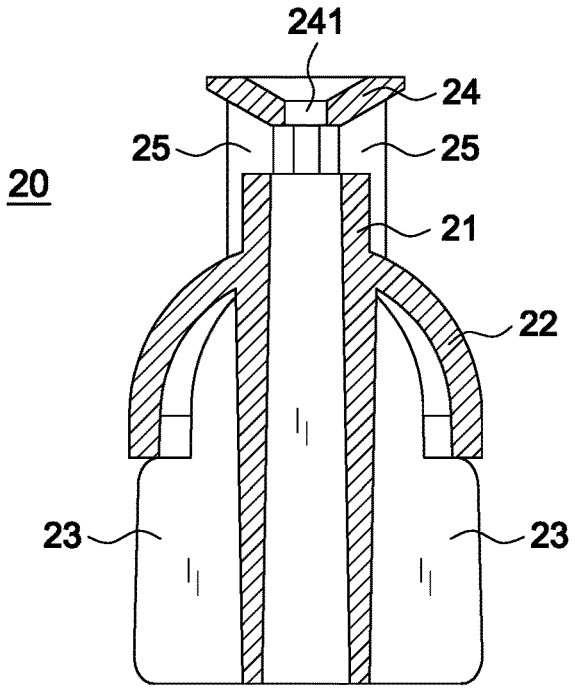
FIG. 5B is a sectional view along line 5B-5B in FIG. 5A.
Figure 6:
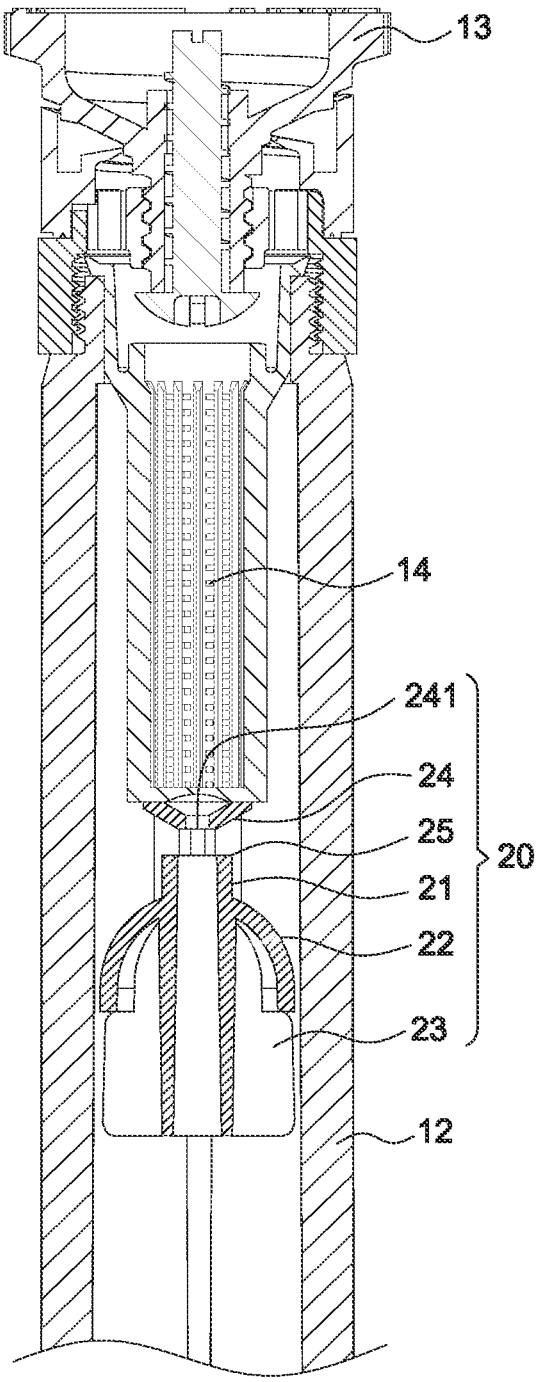
FIG. 6 is a schematic diagram illustrating the structure of a water stream stop valve of the present invention.
Figure 7:
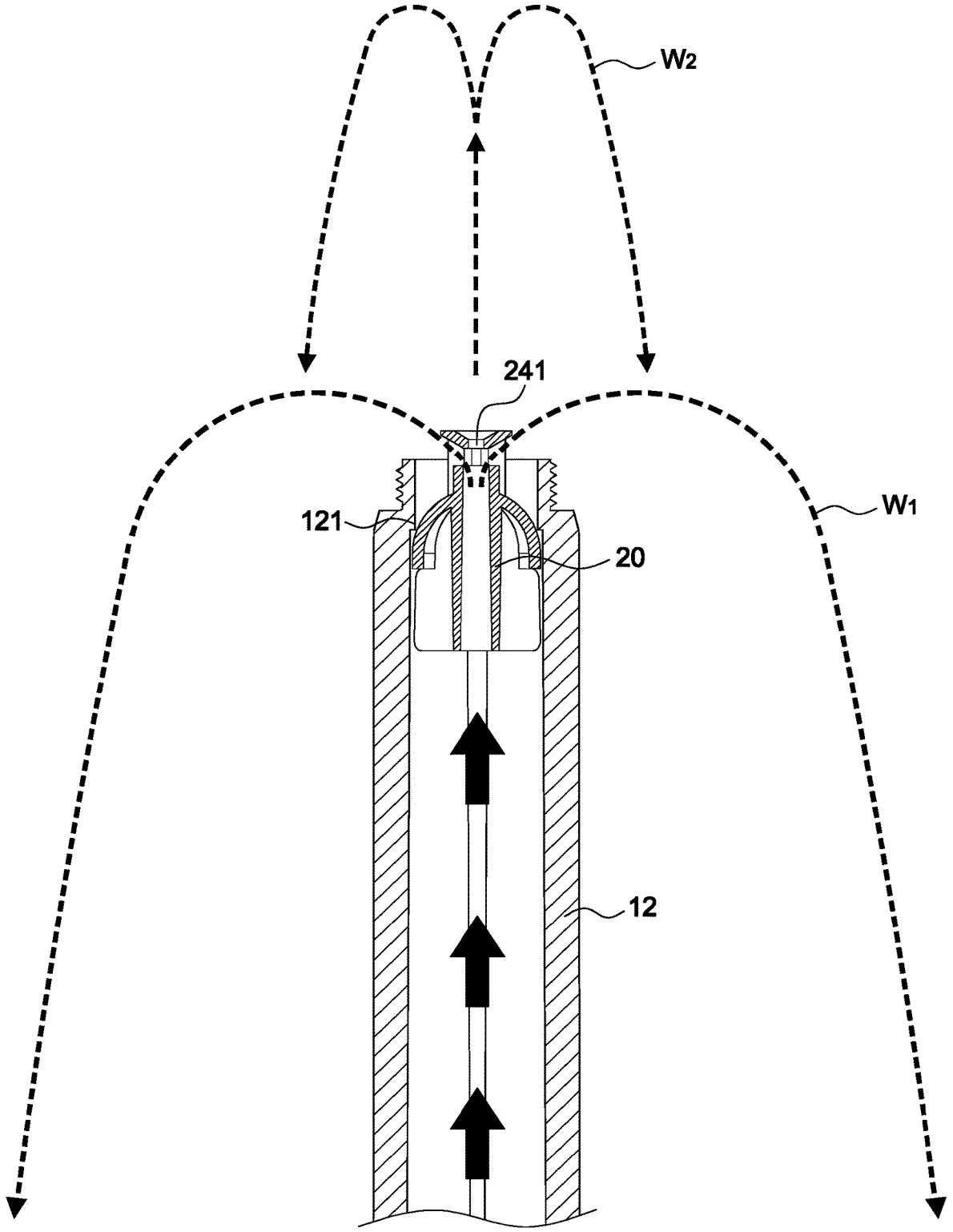
FIG. 7 is a schematic diagram illustrating the application of a water stream stop valve of the present invention.

Referring to FIG. 5A and FIG. 5B, a water stream stop valve 20 of the present invention includes a tube body 21 gradually shrinks from bottom to top, an annular cover 22 arranged on the outer periphery of the tube body 21; and multiple securing units 23 arranged vertically on the outer periphery of the tube body 21, multiple support plates 25 arranged above the tube body 21 and the bottom surface of the drainage body 24 is upwards from the inside to the outside.

With the feature disclosed above, referring to FIG. 1, FIG. 2, FIG. 6, and FIG. 7, when water stream stop valve 20 of the present invention is applied on a pop-up sprinkler 10, wherein the pop-up sprinkler 10 includes: a main body 11; an expansion pipe 12 arranged on the main body 11, and having a stop member 121 arranged at top internal diameter thereof; a spray head 13 arranged at the top edge of the expansion pipe 12; and the water stream stop valve 20 is arranged inside the expansion pipe 12 and below the spray head 13; When the spray head 13 fell off, due to the water pressure, the water stream stop valve 20 will be pushed up to the top of the expansion pipe 12 and stop at the stop member 121 for avoiding the overflow of water, maintaining the spraying W1 at the original area, and delivering a service indication stream W2.

Figure 8:
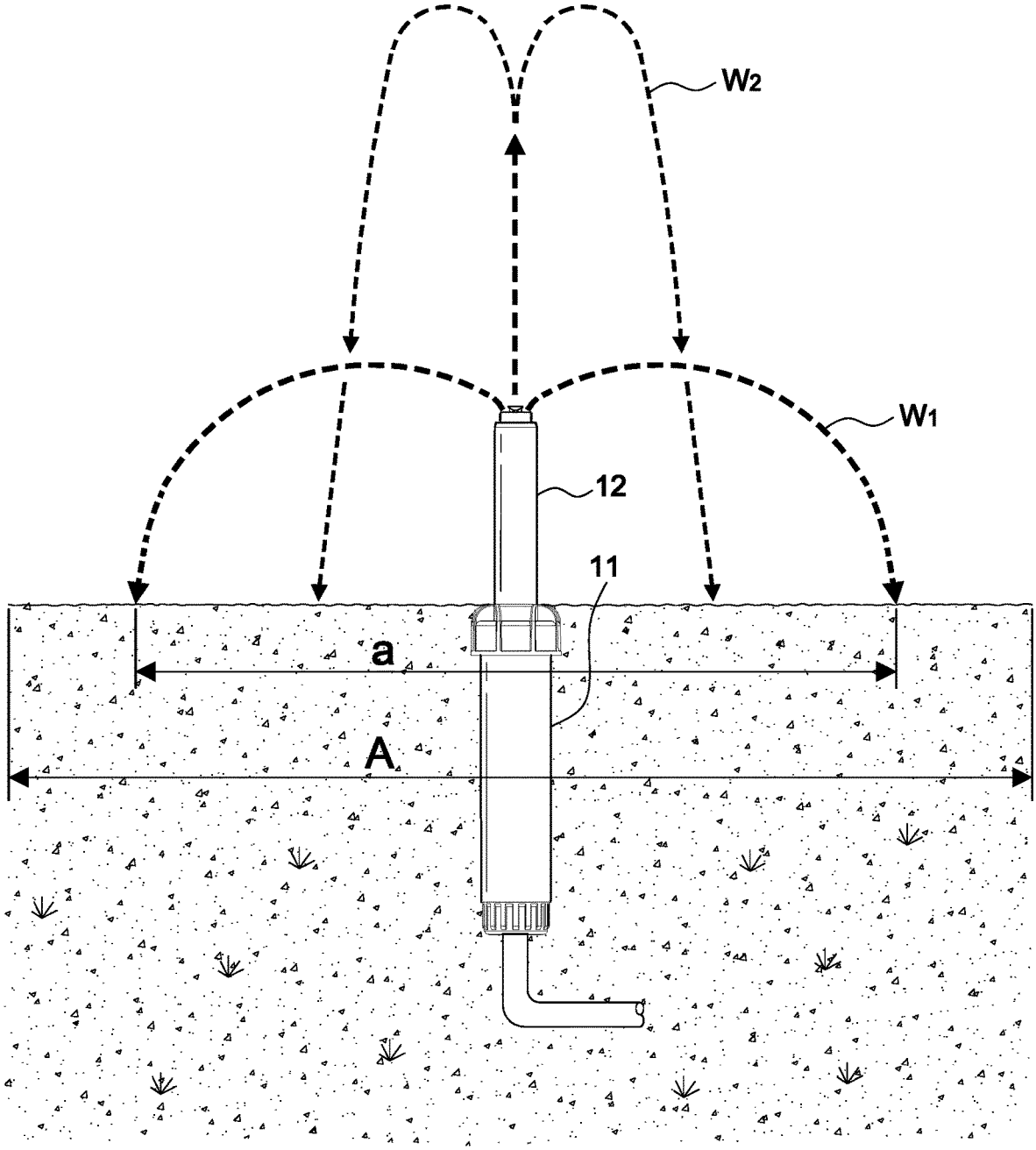
FIG. 8 is a schematic diagram illustrating the spraying of a water stream stop valve of the present invention.

Also, referring to FIG. 8, using the bottom surface of the drainage body 24 to guide the water spraying at the area (a) to be closed to the original spraying area (A) with the spray head 13, and the hole 241 deliver a service indication stream W2 for notifying the user the function error of the pop-up sprinkler 10, and maintaining the spraying W1 at the original area.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A water stream stop valve for a sprinkler, comprising:

a tube body;

an annular cover arranged on an outer periphery of the tube body;

multiple securing units arranged vertically on the outer periphery of the tube body; and a drainage body is arranged above the tube body by multiple support plates, a hole is formed at a center of the drainage body and a diameter of the hole is smaller than a top internal diameter of the tube body;

wherein the water stream stop valve is installed in a pop-up sprinkler, and the pop-up sprinkler includes a main body, an expansion pipe arranged on the main body having a stop member arranged at a top internal diameter of the expansion pipe, a spray head arranged at a top edge of the expansion pipe; and the water stream stop valve is arranged inside the expansion pipe and below the spray head; whereby responsive to the spray head being displaced from the expansion pipe during spraying, the water stream stop valve is pushed up to the top of the expansion pipe by water pressure, stops at the stop member for avoiding an overflow of water, and maintains spraying of water, delivering a service indication stream of water.

2. The water stream stop valve for a sprinkler as claimed in claim 1, wherein the internal diameter of the tube body gradually shrinks from bottom to top.

3. The water stream stop valve for a sprinkler as claimed in claim 1, wherein a bottom surface of the drainage body inclininglyextends away from the multiple support plates toward an outer periphery of the drainage body.

* * * * *